United States Patent [19]

Murch

[11] 4,393,619

[45] Jul. 19, 1983

[54] DOLL EYE HAVING INSERT FORMING THE IRIS

[76] Inventor: Mason D. Murch, 5419 Williams, Wayne, Mich. 48184

[21] Appl. No.: 278,733

[22] Filed: Jun. 29, 1981

[51] Int. Cl.[3] ..... A63H 3/38

[52] U.S. Cl. ..... 46/165

[58] Field of Search ..... 46/165, 166, 167, 168, 46/169 R, 169 A, 169 B, 170; 3/13

[56] References Cited

U.S. PATENT DOCUMENTS

| | | | |
|---|---|---|---|
| 1,289,643 | 12/1918 | Burlich | 46/165 |
| 1,454,046 | 5/1923 | Donovan | 46/165 UX |
| 1,769,582 | 7/1930 | Konoff . | |
| 1,979,321 | 11/1934 | Dunner | 46/165 |
| 2,477,460 | 7/1949 | Larson | 46/165 |
| 2,618,898 | 11/1952 | Wilhelm | 46/169 R |
| 2,653,328 | 9/1953 | Anderson et al. | 3/13 |
| 2,692,391 | 10/1954 | Gougelman | 3/13 |
| 2,810,134 | 10/1957 | Radin | 3/13 |
| 2,991,588 | 7/1961 | Williams | 46/165 |
| 3,120,720 | 2/1964 | Brudney | 46/169 |
| 4,087,867 | 5/1978 | Hickmann et al. | 3/13 |
| 4,324,066 | 4/1982 | Smith et al. | 46/165 |

*Primary Examiner*—F. Barry Shay

*Attorney, Agent, or Firm*—Gifford, VanOphem, Sheridan & Sprinkle

[57] ABSTRACT

A unique doll eye is disclosed which has the realistic appearance of a human eye. The doll eye comprises a substantially spherical body constructed of porcelain and with a hole formed diametrically through it. An eye insert having an elongated stem and a flared out portion at one end of the stem is glued within the hole so that the outer periphery of the eye insert flared out portion conforms substantially with the outer periphery of the spherical body. In addition, the eye insert is constructed of a transparent material and the opposite or inward side of the flared out portion is painted with a suitable color so that the eye insert gives the appearance of the iris of the human eye. The body together with the eye insert is then coated with polyurethane or similar transparent material and the resulting doll eye has a realistic appearance of a human eye.

6 Claims, 9 Drawing Figures

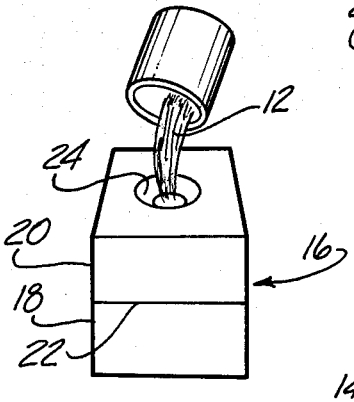
Fig-1
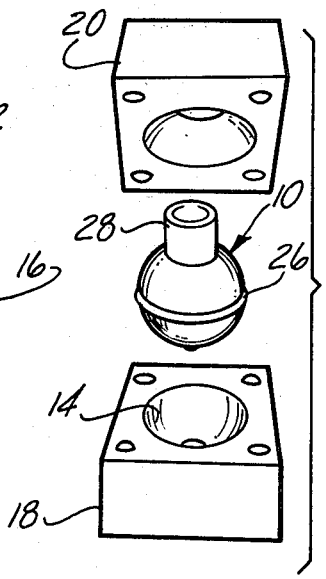
Fig-2
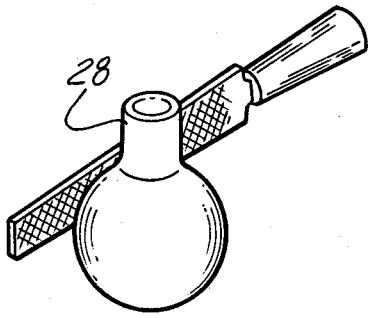
Fig-3
Fig-4
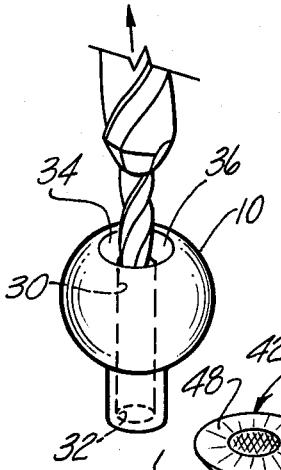
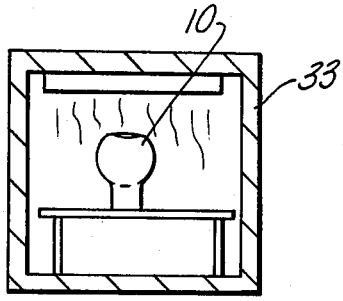
Fig-5
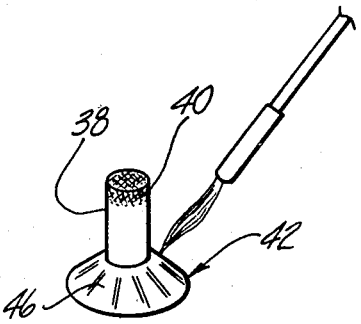
Fig-6
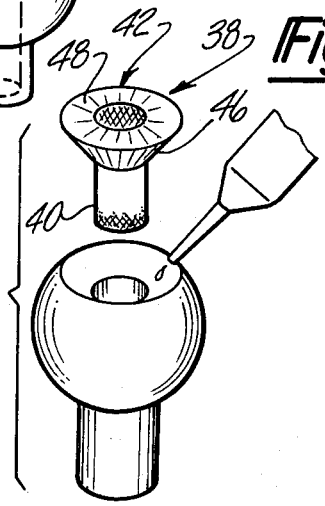
Fig-7
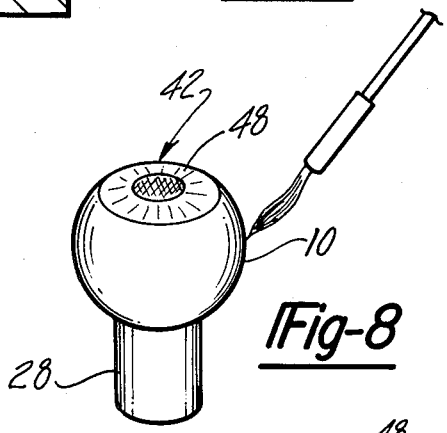
Fig-8
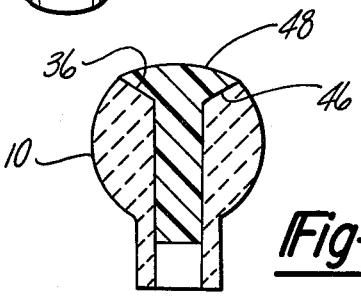
Fig-9

DOLL EYE HAVING INSERT FORMING THE IRIS

BACKGROUND OF THE INVENTION

I. Field of the Invention

The present invention relates generally to artificial eyes and, more particularly, to an artificial doll eye.

II. Description of the Prior Art

There have been a number of previously known artificial doll eyes which are attached to the head of a doll. Many of these previously known doll eyes are very inexpensive in construction and comprise little more than a circular disc attached to the doll head. The previously known doll eyes of this type, however, do not provide the realistic appearance of a human eye.

In certain types of dolls, for example, dolls that are purchased by doll collectors, it is highly desirable for the doll eye to have the appearance, as close as possible, to a human eye. Such dolls are treasured for their realism in human appearance. Moreover, as the dolls become more realistic in appearance, their overall value increases.

Previously, the doll eyes with the most realistic human appearance have been produced by blown glass. Such doll eyes, while having a realistic human appearance, are not only very expensive to purchase but are also in scarce supply and, thus, difficult to obtain.

SUMMARY OF THE PRESENT INVENTION

The present invention overcomes the above-mentioned disadvantages of the previously known doll eyes by providing a doll eye with a very realistic human appearance and which is relatively inexpensive in construction.

In brief, the doll eye according to the present invention comprises a substantially spherical body constructed of a thermal setting clay coating, preferably porcelain. A bore is then drilled substantially diametrically through the eye and the resulting body is then fired in a kiln for hardening.

The doll eye further comprises an eye insert of the type used by taxidermists. As such, the eye insert is constructed of a transparent material, usually plastic, and includes an elongated stem having a flared-out portion at one end. The inside of the flared-out portion is then painted with the desired eye color for the doll eye. After the paint has cured, the stem of the eye insert is positioned in the body throughbore while the painted side of the flared-out portion flatly abuts against the body. Simultaneously, the other or outer side of the flared-out portion substantially conforms to the outer periphery of the body. The eye insert is secured in place in any conventional fashion, such as by gluing.

After the glue has hardened, the body with its attached eye insert is then completely coated at least once and preferably twice by a transparent material, such as polyurethane. After hardening, the overall doll eye has a realistic human appearance.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is a diagrammatic view illustrating a first step in constructing a preferred embodiment of a doll eye according to the present invention;

FIG. 2 is an exploded view illustrating the next step in constructing the preferred embodiment of the doll eye;

FIGS. 3–7 are views illustrating further steps in constructing the preferred embodiment of the doll eye;

FIG. 8 is an elevational view illustrating the finished doll eye; and

FIG. 9 is a cross sectional view illustrating a preferred embodiment of the finished doll eye according to the present invention.

DETAILED DESCRIPTION OF A PREFERRED EMBODIMENT OF THE PRESENT INVENTION

With reference first to FIGS. 1 and 2, the preferred embodiment of the doll eye according to the present invention comprises a generally spherical body 10 constructed of clay and preferably of porcelain. Although the spherical body 10 can be constructed in different fashions, preferably the body 10 is constructed by pouring liquid clay 12 into a spherical molding chamber 14 of a mold 16. The mold 16 includes a lower part 18 and an upper part 20 which meet together along a parting line 22 which substantially bisects the molding chamber 14. The liquid clay 12, in addition, is poured into the molding chamber 14 through a sprue hole 24 so that the molding chamber 14 is completely filled and also so that at least a portion of the sprue hole 24 is filled. In addition, although the mold 16 is illustrated in FIGS. 1 and 2 as having a single molding chamber 14, in practice the mold preferably contains a plurality of chambers 14.

The liquid clay 12 hardens within the molding chamber 14 whereupon the mold parts 18 and 20 are separated (FIG. 2) and the resulting spherical body 10 is removed. The spherical body 10, once removed from the mold 16, is conventionally known as greenware.

With reference now particularly to FIGS. 2 and 3, the spherical body 10 removed from the mold 16 includes a small angular ridge 26 around its midsection which registers with the part line 22 in the mold 16. In addition, the body 10 includes an outwardly extending attachment stem 28 which protrudes radially outwardly from one side of the body 10 and corresponds to the liquid clay originally in the sprue hole 24. The annular ridge 26 is then removed by sanding or filing (FIG. 3) and, at the same time, any surface irregularities on the body 10 are also eliminated by sanding thus forming the semifinished body 10 shown in FIG. 3.

With reference now particularly to FIGS. 4 and 5, a diametric throughbore 30 is then drilled through the semifinished body 10 (FIG. 4) so that one end 32 of the throughbore 30 extends through the attachment stem 28. Conversely, the opposite end 34 of the throughbore 30 tapers outwardly thus forming an annular bevelled portion 36. The semifinished body 10 is then fired in a kiln 33 (FIG. 5) which hardens the body in the well known fashion.

With reference now particularly to FIGS. 6 and 7, the doll eye of the present invention further comprises an eye insert 38 of the type used by taxidermists. The eye insert 38 is constructed of a transparent material, such as plastic, and includes an elongated stem 40 with a flared-out portion 42 at one end. The side of the flared-out portion 42 closest to the stem 40 tapers outwardly forming an annular bevelled portion 46 while the opposite side 48 of the flared out portion 42 is generally convex in shape. The bevelled surface 46 of the eye insert 38 is then painted (FIG. 6) in the desired color of the iris for the finished doll eye.

With reference to FIGS. 7–9, after the paint has dried, the stem 40 of the eye insert 38 is positioned into the body throughbore 30 whereupon the eye insert bevelled surface 46 substantially flatly abuts against the annular tapered surface 36 on the body 10 (FIG. 9). Simultaneously, the outer convex surface 48 on the eye insert 38 substantially conforms to the outer periphery of the body 10 (FIG. 9). The eye insert 38 is then secured to the body 10 in any conventional fashion, such as by gluing (FIG. 7).

After the glue between the eye insert 38 and the body 10 has dried, the entire body 10 as well as the convex surface 48 on the eye insert 38 is then glazed with polyurethane or other transparent protective material as shown in FIG. 8. The body 10 and eye insert 38 are coated with at least one and preferably two coats of the transparent protective material.

After the transparent protective material has dried, the doll eye construction is completed. In practice, the doll eye according to the present invention provides a very realistic outer appearance of the human eye and the attachment stem 28 provides a convenient means for attaching the doll eye to the head of a doll (not shown).

From the foregoing, it can be seen that the doll eye according to the present invention is highly advantageous in several different respects. First, the final color for the doll eye can be easily varied by simply painting the bevelled surface 46 of the eye insert 38 any desired color while the remaining components of the doll eye remain the same. The doll eye according to the present invention is further advantageous in that it can be relatively inexpensively constructed and yet provides a highly desirable realistic human appearance.

Having described my invention, however, many modifications thereto will become apparent to those skilled in the art to which it pertains without deviation from the spirit of the invention as defined by the scope of the appended claims.

I claim:

1. A doll eye comprising:

a substantially spherical solid body constructed of a thermosetting clay, said body having a substantially cylindrical and diametric bore formed through it, an eye insert having an elongated stem and an annular flared-out portion at one end of the stem, means for securing said eye insert to said body so that said stem protrudes into said bore and so that the outwardly facing side of said flared-out portion substantially conforms to the outer periphery of the body, wherein said eye insert is constructed of a transparent material having a coating of colored material on the other side of said eye insert flared-out portion, said coating of colored material determining the extent and color of the iris in the finished eye, and a coating of transparent material on the outer periphery of said body and said outwardly facing side of said flared-out portion.

2. The invention as defined in claim 1 wherein said securing means comprises glue.

3. The invention as defined in claim 1 wherein said clay is porcelain.

4. The invention as defined in claim 1 wherein said transparent material is polyurethane.

5. The invention as defined in claim 1 wherein said body includes an attachment stem which protrudes outwardly at the side of said body opposite said bore.

6. The invention as defined in claim 1 wherein the outermost end of said bore is bevelled and flatly abuts against the other side of said eye insert.

* * * * *